United States Patent [19]

Val et al.

[11] 4,413,170

[45] Nov. 1, 1983

[54] THERMAL PRINTING HEAD

[75] Inventors: Christian Val; Didier Pribat, both of Paris, France

[73] Assignee: Thomson-CSF, Paris, France

[21] Appl. No.: 274,376

[22] Filed: Jun. 17, 1981

[30] Foreign Application Priority Data

Jun. 24, 1980 [FR] France ..... 80 13967

[51] Int. Cl.[3] ..... H05B 1/00

[52] U.S. Cl. ..... 219/216; 219/505; 219/543; 338/22 R; 101/1

[58] Field of Search ..... 219/216, 504, 505, 543, 219/553; 338/22 R, 22 S D, 23, 24, 25, 308; 101/1

[56] References Cited

U.S. PATENT DOCUMENTS

| | | | |
|---|---|---|---|
| 2,915,724 | 12/1959 | Fritts | 338/23 |
| 3,973,106 | 8/1976 | Ura | 219/216 |
| 4,206,541 | 6/1980 | Marciniec | 219/216 X |
| 4,246,468 | 1/1981 | Horsma | 219/553 |

FOREIGN PATENT DOCUMENTS

| | | |
|---|---|---|
| 2220139 | 9/1974 | France . |
| 2311410 | 6/1978 | France . |

OTHER PUBLICATIONS

Kitamura, IBM, Technical Disclosure Bulletin, "Thermal Printer Head Free From Overheating", vol. 16, No. 8, Jan. 1974.

*Primary Examiner*—Volodymyr Y. Mayewsky

[57] ABSTRACT

An electrical heating resistor of the type deposited on a substrate plate constituting the basis element of a thermal printing head. In order to concentrate the heat given off in the free surface of said heating resistor towards the paper to print, the invention provides for the deposition on the substrate of at least one layer having a relatively constant resistivity and then at least one surface layer with a non-linear resistivity and a negative temperature coefficient. Starting from a high value when cold, the resistance of the surface layer drops abruptly as soon as it reaches the triggering temperature, thus switching the heat resistor by command of a control circuit.

6 Claims, 5 Drawing Figures

THERMAL PRINTING HEAD

BACKGROUND OF THE INVENTION

The present invention relates to a system of heating elements of the type comprising resistors connected in series in the form of linear plates, more particularly intended for the construction of thermal printing heads. It also relates to the control circuit for the thermal printing heads, which is simplified by the adopting of resistors according to the invention.

Thermal printers are peripheral devices in information processing or telecommunications systems in which the printing of a line of text is obtained by means of a strip of heating resistors. The heat given off by an elementary resistor chemically modifies the paper on which printing is taking place. The printing of a line of characters by means of a thermal printing head is obtained by the repetition of several lines of dots at the rate of 8 dots per millimeter. A thermal printing head for a standard paper size of width 21 cm comprises 1728 resistors deposited on a glass or ceramic plate. The width of each resistor is approximately 250 microns and they are also 250 microns apart.

There are two problems in connection with thermal printing heads, namely that of the control of a given resistor and that of heat dissipation. Each unitary programmed resistor is controlled by a circuit comprising, inter alia, two transistors and a diode. The diodes which are connected in series with the non-programmed resistors limit the potential at the terminals thereof and prevent heating thereof. Thus, a thermal printing head requires a circuit having the same number of diodes as there are heating resistors or preferably, as a function of the diagram adopted, a number of diodes which is equal to half the number of heating resistors, there being a large number of diodes because there are at least 863 diodes for 1728 points.

BRIEF SUMMARY OF THE INVENTION

The resistors according to the invention comprising at least one layer functioning as a non-linear resistor with a negative temperature coefficient and with a triggering point have characteristics making it possible to eliminate the diodes in the supply circuit for the heating resistors. Moreover, the heating resistors, which are of small size, have a low thermal capacity and the heat given off is partly absorbed by the substrate, whose thermal capacity is much higher.

Thus, a linear strip of heating resistors is formed on a substrate constituted by a glass or ceramic plate, whose length is equal to the width of the printing paper and whose thickness is approximately a few millimeters so as to ensure the rigidity of the thermal printing strip, whilst also ensuring that it is not fragile and delicate.

Thus, the present invention leads to an improvement of thermal printing heads in which the heating resistors comprise a hotter outer layer which dissipates the heat preferably towards the paper rather than towards the substrate plate.

More specifically, the present invention relates to an electrical heating resistor deposited on an insulating glass or ceramic substrate, whose thermal capacity is well above that of the heating resistor, wherein it comprises at least a first layer of a material having a relatively constant resistivity as a function of the temperature and which is deposited on the substrate and at least a second surface layer of a material whose resistivity varies in non-linear manner with the temperature and having a negative temperature coefficient, said second layer being deposited on the first layer.

BRIEF DESCRIPTION OF THE DRAWINGS

The invention is described in greater detail hereinafter relative to a non-limitative embodiment of a thermal printing head and with reference to the attached drawings, wherein show.

DETAILED DESCRIPTION OF THE PREFERRED EMBODIMENTS

Figure 1:
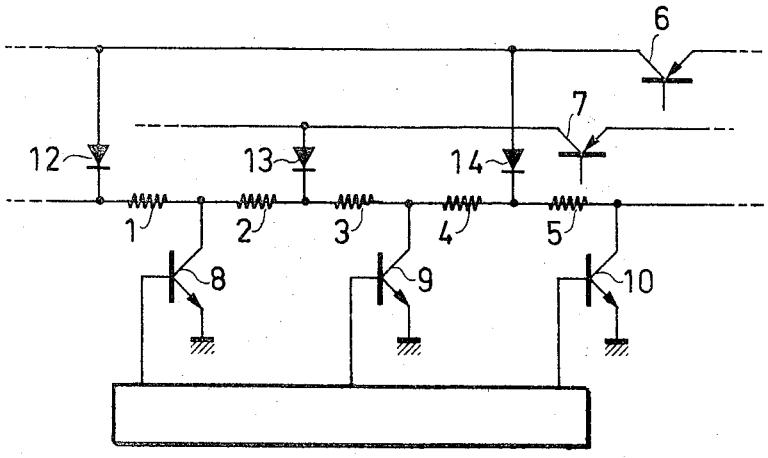
FIG. 1 PRIOR ART
FIG. 1 a circuit diagram according to the prior art of the power supply for the resistors of a thermal printing head.

FIG. 1 shows the circuit diagram of the power supply for the heating resistors in a thermal printing head. Its operation will render more apparent the advantages of the present invention. In view of the large number of heating resistors in a thermal printing head, i.e. 863 or 1728 resistors as a function of the diagram adopted for a standard paper size, only part of the head is shown in FIG. 1.

The heating resistors 1 to 5 are arranged in series and are supplied in groups from a plurality of power transistors, whereof two are shown and designated 6, 7. Power transistor 6 supplies resistors 1, 4 and 5, whilst power transistor 7 supplies resistors 2 and 3. The groups are interdigitated and the choice or programming of a resistor which is to heat is determined by a transistor 8, 9 or 10, whose base is controlled by a shift register. Resistor 1 is controlled by transistors 6 and 8, resistor 2 is controlled by transistors 7 and 8, resistor 3 is controlled by transistors 7 and 9 and so on.

To ensure that the power fed into a resistor does not pass across other resistors, it is necessary to arrange diodes in series with the power transistors 6 and 7, these being constituted by diodes 12, 13 and 14 in FIG. 1. Thus, the prior art heating resistors have relatively low values and the leakage current only across one unprogrammed transistor is sufficient to heat an unprogrammed resistor. The presence of diodes limits the potential at the terminals of unprogrammed resistors.

Although FIG. 1 only shows part of the circuit diagram of a thermal printing head, it is apparent therefrom that it is necessary to provide a large number of diodes installed on relatively complex circuits as a result of the large number of conductors and the large number of welds required, which constitutes a disadvantage for the industrial connection of a thermal printing head.

The replacement of conventional heating resistors by the heating resistors according to the invention provides the advantage of eliminating the diodes due to the high value of the heating resistors when cold and which drops very rapidly as soon as the surface layer constituted by a resistor with a negative temperature coefficient (NTC) has reached and exceeded its triggering point.

Figure 2:
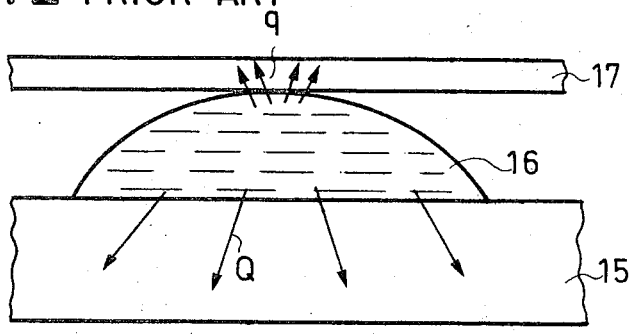
FIG. 2 PRIOR ART
FIG. 2 a sectional view of a heating resistor according to the prior art showing the thermal dissipation.

FIG. 2 is a sectional view of a prior art heating resistor, which provides a greater understanding of the heat dissipation problems. A heating resistor is deposited on a glass or ceramic substrate 15 and the sheet of paper 17 moves in contact with said resistor. The relative scales of FIG. 2 have been adopted so as to provide a better understanding of the drawing and for a thickness of substrate 15 of approximately 1 to 5 mm each heating resistor 16 deposited by silk screen printing, vacuum metallization or any similar process, has a thickness which is at the best a few tenths millimeters. Moreover, the prior art resistors are deposited by means of 1 or more passages by accumulation of films which are all produced from the same base material and consequently all the films have the same resistivity and temperature coefficient characteristics.

When a heating resistor 16 is programmed, the heat which it gives off is symbolized in FIG. 2 by means of arrows which represent a heat quantity "Q" which is dissipated towards the substrate, whilst other arrows represent a heat quantity "q" dissipated towards the sheet of paper. The thermal capacities in the presence of the thick substrate 15, the relatively thin resistor 16 and the paper sheet 17, which also passes in front of the resistor, lead to a good proportion of the energy used being dissipated towards the substrate, which is not the sought objective.

Figure 3:
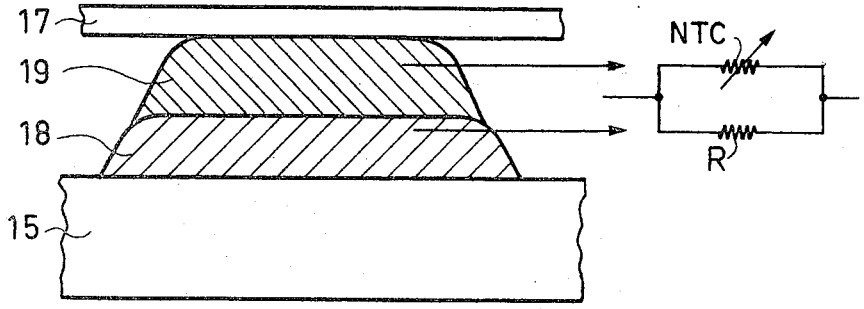
FIG. 3 a sectional view of a heating resistor according to the invention.

The replacement of such a conventional resistor by a resistor according to the invention, apart from the advantage described in connection with FIG. 1, makes it possible to dissipate the heat in preferred manner towards the paper sheet. Thus, the use of resistors according to the invention make it possible to subdivide the complete electronic control part, because the energy required is less and the components such as transistors have to dissipate less energy. FIG. 3 shows a sectional view of a resistor according to the invention.

On a substrate plate 15 are deposited by any known process at least a first resistance layer 18, which is conventionally called fixed compared with a second resistance layer 19 variable in non-linear manner with a negative temperature coefficient. On the side of FIG. 3 is symbolized the circuit diagram of the two resistors 18, 19, the first layer 18 being a fixed resistor and the second layer 19 an NTC resistor of a variable nature mounted in parallel with fixed resistor R. At ordinary temperature, the two resistors 18, 19 constituting the resistor according to the invention have a high value. When a current is fed via control transistors across said heating resistor, resistor R heats the variable NTC resistor until the latter reaches its switching point. As from this temperature the resistance of the NTC drops considerably, so that the latter becomes conductive and the heat given off is largely dissipated by the outer surface of the heating resistor, i.e. in contact with the sheet of paper.

The first resistance layer 18 can be of the linear type, i.e. its value does not vary with the temperature, as opposed to the variation of the NTC. However, according to an improvement of the invention, the first layer is constituted by a resistor with a positive temperature coefficient (PTC), i.e. it behaves like a linear resistor to its triggering temperature at which its resistance increases considerably and in an abrupt manner. However, this solution requires a relatively good choice of materials for the PTC and the NTC in such a way that the triggering temperatures substantially overlap, i.e. the NTC becomes "conductive" when the PTC stops being conductive.

To simplify the drawing and the description only the limit case according to the invention is shown when a single fixed resistance layer 18 is deposited on the substrate. A more general case, which will be described hereinafter, provides for the successive deposition of several fixed resistance layers.

To ensure that part of the heat given off by NTC resistor 19 when it has exceeded its triggering point is not passed to substrate 15, according to the invention layer 19 is deposited on layer 18 without projecting beyond the same in such a way that layer 19 is not in contact with substrate 15.

Figure 4:
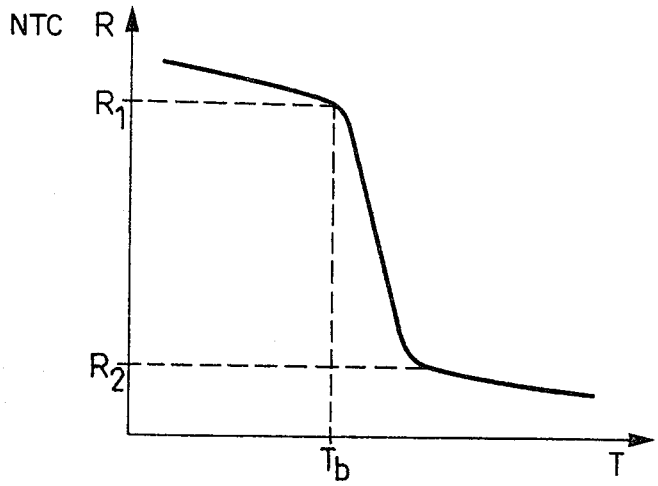
FIG. 4 a graph of the resistance characteristics as a function of the temperature of a resistor with a negative temperature coefficient.

FIG. 4 shows the resistance characteristics as a function of the non-linear resistors with a negative temperature coefficient.

The temperatures are given on the abscissa and the resistance of the NTC resistor on the ordinate. When an NTC resistor heats, its resistance gradually decreases until a so-called triggering temperature $T_b$ is reached. In a narrow temperature range around the triggering temperature $T_b$, i.e. $\pm 3$ to 5° C. on average, the resistance of the NTC drops considerably and it is at present possible to produce NTC's, whose resistance on either side of the triggering temperature has a coefficient exceeding $10^3$ and reaching $10^4$ to $10^5$. Thus, it is possible to produce so-called thermistors which, for an initial value of $2.10^4$ to $10^5$ Ohms at ordinary temperature only have 2 to 5 Ohms at 80° C.

Thus, the heating resistors according to the invention have the advantage of a high value at ordinary temperature whilst, when programmed and when the underlying resistance layer has heated the variable resistance layer, they only have a low resistance value. This makes it possible to eliminate the diodes in the supply circuit because the unprogrammed resistors have high values and in addition the heat is only dissipated in the direction of the paper.

An improvement of the invention consists of permanently programming a low current across the system of heating resistors in such a way that they are maintained at a constant temperature, apart from any programming and which is just below the triggering temperature. Thus, when a resistor has to be programmed to print a dot on the sheet of paper, it is merely necessary to have a low current across the circuit of control transistors for switching the surface layer to a negative temperature coefficient, which increases the response rate of the thermal printing head and makes it possible to reduce the necessary power dissipated across the control transistors.

Figure 5:
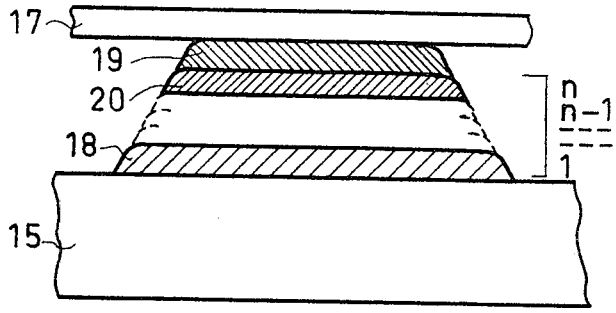
FIG. 5 a sectional view of an improved variant of a resistor according to the invention.

FIG. 5 shows an improvement made to the system of heating resistors according to the invention. The description of the invention relative to FIG. 3 is based on the simplest case when a variable resistivity layer 19 is deposited on a single constant resistivity layer 18. However, it constitutes an advance to provide a single variable resistivity layer 19 on a plurality of constant resistivity layers, whereof two are shown at 18 and 20 in FIG. 5.

Thus, according to this improvement of the invention, it is advantageous to deposit the variable resistivity layer 19 on a support formed by a plurality of layers 1 to n, the resistivity of each layer decreasing from layer 1 to layer n. Moreover, each layer is deposited in such a way that only the first layer touches the substrate 15 of the thermal printing head, so as to focus the heat given off in each layer and which is greater in one layer than in the preceding layer towards the outer surface of the thermal resistor. Thus, the outer surface is hotter and modifies the paper used in the thermal printer.

The invention has been described on the basis of a strip of resistors for a thermal printing head. However, it is also applicable to all cases where a large number of resistors has to be programmed for controlling a large number of elements, such as display panels or any other electronic device in which the same control operations are repeated a large number of times by means of resistors. In addition, the improvements which can be made by the Expert in the field of negative temperature coefficient resistors also fall within the scope of the invention.

What is claimed is:

1. A thermal printing head comprising at least one strip of linear heating resistors, wherein each resistor is deposited on an insulating glass or ceramic substrate, whose thermal capacity is well above that of the heating resistor, and wherein it comprises at least a first layer of a material having a relatively constant resistivity as a function of the temperature and which is deposited in direct contact with the substrate and at least a second surface layer of a material whose resistivity varies in non-linear manner with the temperature and having a negative temperature coefficient, said second layer being deposited on the first layer.

2. A thermal printing head according to claim 1, wherein its resistance, which is high at ordinary temperature (20° C.) becomes low as soon as the resistivity layer traversed by a current brings the variable resistivity layer to the temperature where there is a sudden change in its resistivity, called the triggering temperature of the NTC.

3. A thermal printing head according to claim 2, wherein as soon as the variable resistivity layer reaches its triggering temperature, the heat given off is localized in said surface layer.

4. A thermal printing head according to claim 1, wherein the variable resistivity surface layer is kept at a temperature which is close to and slightly below its triggering temperature by applying a permanent current traversing the underlying resistive layer.

5. A thermal printing head according to claim 1, wherein the variable resistivity surface layer is deposited on a plurality of constant resistivity layers which in turn are deposited on said first layer, the resistivity of the constant resistivity layers decreasing from that deposited in direct contact with the substrate to that which is below the surface layer.

6. A thermal printing head according to claim 1, comprising series-connected heating resistors supplied by power transistors and controlled by control transistors, each of which authorises the passage of current through a given resistor, wherein the heating resistors are connected by direct connections to the power transistors and to the control transistors.

* * * * *